US007234770B1

(12) United States Patent
Schiebl

(10) Patent No.: US 7,234,770 B1
(45) Date of Patent: Jun. 26, 2007

(54) PORTABLE INFLATABLE SEAT CUSHION

(76) Inventor: Paul Schiebl, 1513 Story St., Houston, TX (US) 77055

( * ) Notice: Subject to any disclaimer, the term of this patent is extended or adjusted under 35 U.S.C. 154(b) by 0 days.

(21) Appl. No.: 11/203,918

(22) Filed: Aug. 15, 2005

Related U.S. Application Data

(63) Continuation-in-part of application No. 10/966,399, filed on Oct. 14, 2004, now abandoned, which is a continuation-in-part of application No. 10/640,726, filed on Aug. 13, 2003, now abandoned.

(51) Int. Cl.
*A47C 31/00* (2006.01)

(52) U.S. Cl. ..... 297/219.1; 297/228.12; 297/252

(58) Field of Classification Search ..... 297/219.1, 297/228.1, 228.11, 228.12, 228.13, 229, 230.1, 297/230.13, 252, 352
See application file for complete search history.

(56) References Cited

U.S. PATENT DOCUMENTS 1,596,580 A * 8/1926 Carver ..... 297/228.12
3,043,622 A * 7/1962 Milner ..... 297/228.12 X
3,112,956 A * 12/1963 Edward et al. ..... 297/219.1
3,167,790 A * 2/1965 Hickey ..... 297/252 X
3,220,767 A * 11/1965 Hendrickson ..... 297/228.12
4,597,386 A 7/1986 Goldstein ..... 297/230.13
4,630,863 A * 12/1986 Roberts ..... 297/219.1
4,925,241 A 5/1990 Geraci ..... 297/219.1
5,297,848 A * 3/1994 Grinnell ..... 297/219.1
5,403,066 A * 4/1995 Drum ..... 297/219.1
5,868,463 A 2/1999 MacKenzie et al. ... 297/228.12
6,390,550 B1 * 5/2002 Paredes et al. ..... 297/219.1 X
6,588,840 B1 * 7/2003 Lombardo ..... 297/228.12
6,929,325 B1 * 8/2005 Goelo ..... 297/219.1
2002/0021034 A1 * 2/2002 Morgan et al. ..... 297/228.12
2005/0146177 A1 * 7/2005 Jerome ..... 297/219.1

* cited by examiner

*Primary Examiner*—Rodney B. White
(74) *Attorney, Agent, or Firm*—Egbert Law Offices

(57) ABSTRACT

A portable seat cushion for a bench has an inflatable panel, a strap having an end affixed to a back side of panel and extending outwardly therefrom, a first fastener affixed to a front side of the panel, and a second fastener affixed to the strap at an end opposite the panel. The second fastener is suitable for affixing to the first fastener when the bottom surface of the panel is placed upon a bench and the strap is extended along an underside of the bench toward the front side of the panel. The strip can have an elastic section formed therealong. A valve allows air to be selectively introduced into the interior compartment of the inflatable panel.

14 Claims, 4 Drawing Sheets

PORTABLE INFLATABLE SEAT CUSHION

RELATED U.S. APPLICATIONS

The present application is a continuation-in-part of U.S. patent Ser. No. 10/966,399, filed on Oct. 14, 2004 now abandoned, and entitled "Stadium Seat Cushion". U.S. application Ser. No. 10/966,399 was a continuation-in-part of U.S. patent application Ser. No. 10/640,726, filed on Aug. 13, 2003, now abandoned.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to lightweight portable seat cushions that can be secured to a seat surface. More particularly, the present invention relates to such seat cushions that are inflatable. Additionally, the present invention relates to valves that can be used in association with inflatable seat cushions so as to allow air to be easily introduced into the interior of the inflatable seat cushion while also allowing air to be easily removed from the seat cushion, as required.

BACKGROUND OF THE INVENTION

Outdoor facilities typically provide benches or seats to facilitate use by spectators. Often the spectators pay for admission or otherwise provide a form of compensation to the host of the outdoor event. Enhancing the comfort of spectators can increase attendance and thereby may increase revenue received by the event host.

However, most outdoor facilities have little or no form of seat cushioning. This is in part due to the harsh outdoor environment. The seats are often permanently installed outdoors. Any seat or bench cushions or padding device may also be subject to vandalism or destruction by natural elements. There is accordingly a need for a lightweight, compact inexpensive cushion that can be carried by an individual and that is adaptable for use with seats, benches or bleachers. There is also a need for a cushion that can be temporarily fastened to the bleacher, bench seat or similar structure in order that it will stay in place when the occupant shifts position, stands or moves. It can be readily appreciated that an unsecured cushion may drop down from a bleacher-seating surface to the support structure below, and may be permanently lost to the user.

Furthermore, it is beneficial to have a seat cushion that can also be utilized to increase seating comfort when used in any outdoor or indoor environments, including improving indoor seating and seating during outdoor activities that do not involve seats or benches, such as camping, beach activities and picnics.

In past, various patents have issued relating to such seat cushions. For example, U.S. Pat. No. 4,597,386, issued on Jul. 1, 1986 to M. I. Goldstein, teaches a lumbar support system. This lumbar support system includes a panel and a cushion assembled in supporting contact. The panel is flexibly formed in the transverse shape of a columnar beam providing rigidity on the longitudinal axis of the lumbar lordosis of a human body.

U.S. Pat. No. 4,925,241, issued on May 15, 1990 to R. J. Geraci, describes a portable seat cushion for sporting events. This portable seat cushion includes a pair of cushions that are joined together by a flexible hinge at one end. This allows a variety of seating configurations. Each of the cushions includes a flexible enclosure having a resilient material contained therein. An elastic strap is attached to the opposite side of the back surface of at least one cushion. This elastic strap may be used to surround the associated portion of a chair, thereby retaining the portable cushion in a selected position. A hook-and-loop fastener is provided to releasably join the two cushions at generally the ends opposite the flexible hinge.

U.S. Pat. No. 5,868,463, issued on Feb. 9, 1999 to MacKenze et al., describes a seat cushion with selectively inflatable interior seat and back compartments. The compartment has an openable and closable seat valve for selectively communicating with ambient atmosphere. The foam within the compartment is expanded and compressed within the seat compartment in relation to selective application of a compression force acting on the seat valve that is opened to selectively draw inflating air into and exhaust inflating air from the seat compartment.

It is an object of the present invention to provide an inflatable seat cushion that can be used on a bench at sporting events, camping activities, boating and other outdoor activities.

It is another object of the present invention to provide an inflatable seat cushion which allows air to be easily introduced into and removed from the interior compartment of the seat cushion.

It is another object of the present invention to provide a portable seat cushion whereby the cushion can be attached to a variety of different widths and/or lengths of benches.

It is a further object of the present invention to provide a portable seat cushion that can be easily folded and stored in a compact configuration.

It is an additional object of the present invention to provide a portable inflatable seat cushion that can be secured to a person's belt.

It is a further object of the present invention to provide a portable seat cushion having a convoluted surface that easily and comfortably conforms to the buttocks of a person sitting on the cushion.

It is an additional object of the present invention to provide a portable seat cushion that is easy to use, easy to inflate, easy to deflate, easy to store, relatively easy to manufacture and relatively inexpensive.

These and other objects and advantages of the present invention will become apparent from a reading of the attached specification and appended claims.

BRIEF SUMMARY OF THE INVENTION

The present invention is a portable seat cushion for use on a bench. This portable seat cushion has an inflatable panel with a top surface and a bottom surface joined together so as to define an interior compartment. The panel has a front side and a backside. A strap has an end affixed to the backside of the panel and extends outwardly therefrom. This strap has an elastic section formed therealong. A first fastener is affixed to a front side of the panel. A second fastener affixed to the strap at an end opposite the panel. The second fastener is suitable for affixing to the first fastener when the bottom surface of the panel is placed upon the bench and the strap is extended along an underside of the bench toward the front side of the panel.

In the inflatable panel of the present invention, the top surface has a plurality of convolutions defined thereon when the panel is inflated. Similarly, the bottom surface has a plurality of convolutions defined thereon when the panel is inflated. The convolutions of the top surface are generally aligned with the convolutions of the bottom surface.

The strap has a top surface and a bottom surface. The second fastener is affixed to the bottom surface of the strap. A third fastener is affixed to a top surface of the strap inwardly of the end thereof. This third fastener is joinable to the first fastener when the panel is deflated and folded. A belt-engaging member is affixed to the top surface of the strap. This belt-engaging member is positioned between the third fastener at an end of the strap. The belt-engaging member includes a strip hingedly connected to the strap. This strip has hook-and-loop material affixed thereto at an end opposite the hinged connection with the strap. The strip extends transverse to a longitudinal axis of the strap and positioned between the third fastener and the end of the strap on the top surface of the strap. A complementary hook-and-loop material is affixed the top surface of the strap. The hook-and-loop material of the strip releasably engages with the complementary hook-and-loop material so as to allow the seat cushion to be secured to a belt of a person.

The elastic section extends between the third fastener and the panel. The strap further includes a first portion extending outwardly from the backside of the panel. The elastic section has an end opposite the panel that is joined to and end of the first portion. The second portion has an end joined to an end of the elastic section opposite the elastic first portion. The second and third fasteners are affixed to the second portion of the strap.

In the present invention, a valving means is affixed to one of the top surface and the bottom surface of the inflatable panel. This valving means allows air to be selectively introduced into and released from the interior compartment of the panel. The valving means includes a housing having a flange affixed to an interior surface of the inflatable panel. The housing has a tubular portion extending from the flange outwardly of one of the surfaces form the panel. The tubular portion and the flange define a hole extending therethrough. A button is slidably mounted in the hole. This button has a face at one end thereof. A sealing member is affixed to an end of the button opposite the face. The sealing member is positioned adjacent the flange on a side opposite the tubular portion. The sealing member has a diameter greater than a diameter of the hole. A spring is positioned within the hole and bears against the button so as to urge the sealing member against the flange. The spring has a resiliency suitable for allowing the sealing member to move away from the flange upon an application of human-produced breath through the hole.

In the present invention, the first fastener is a section of hook-and-loop material. The second fastener is a section of complementary hook-and-loop material.

BRIEF DESCRIPTION OF THE SEVERAL VIEWS OF THE DRAWINGS

In FIG. 8, the valve is illustrated in its closed position.

DETAILED DESCRIPTION OF THE INVENTION

Figure 1:
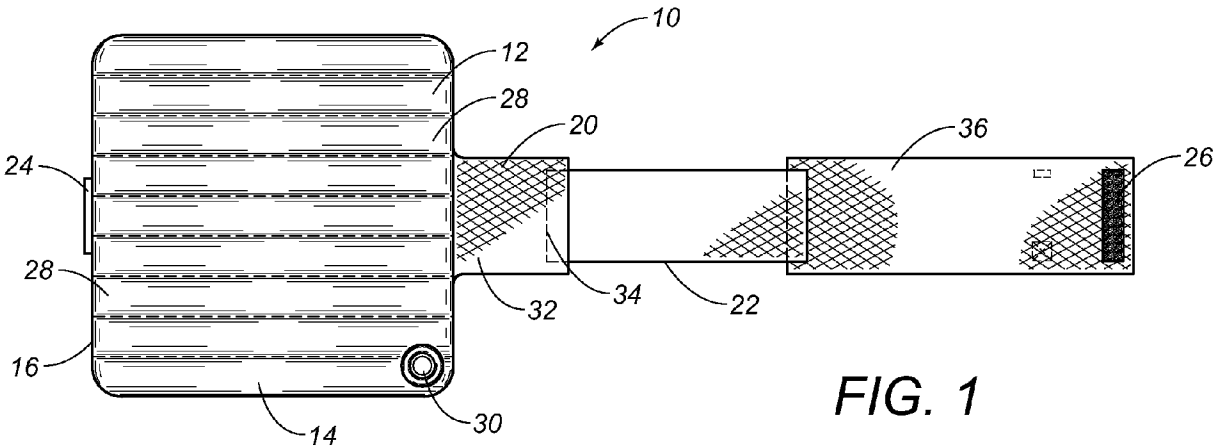
FIG. 1 is a bottom view of the unfolded seat cushion in accordance with the preferred embodiment of the present invention.

Referring to FIG. 1, there is shown the portable seat cushion 10 in accordance with the preferred embodiment of the present invention. The illustration of FIG. 1 is a bottom view of the unfolded configuration of the seat cushion 10. The seat cushion 10 includes an inflatable panel 12 having a top surface and a bottom surface 14. The top surface is joined to the bottom surface 14 so as to define an interior compartment therein. The panel has a front side 16 and a back side 18. A strap 20 has an end affixed to the back side 18 of the panel 12 and extends outwardly therefrom. The strap 20 includes an elastic section 22 formed therealong. A first fastener 24 is affixed to the front side 16 of the panel 12. A second fastener 26 is affixed to the strap 20 at an end opposite the panel 12. The second fastener 26 is suitable for affixing to the first fastener 24 when the bottom surface 14 of the panel 12 is placed upon a bench and the strap 20 is extended along an underside of the bench toward the front side 16 of the panel.

Specifically, the panel 12 is in the nature of an air mattress in that the edges of the panel 12 are sealed together so as to form an airtight interior compartment. A plurality of convolutions 28 are formed on the bottom surface 14 when the panel 12 is inflated. These convolutions can be in the nature of corrugations or undulating surfaces similar to the ribs of an air mattress. It has been found that these convolutions provide a stable shape and tend to increase the comfort of the person sitting on the cushion 10. A valve 30 is affixed to the bottom surface 14 of the panel 12 adjacent one corner thereof. Valve 30 is unique to the present invention and is described in greater detail in association with FIGS. 8–11 herein.

The strap 20 includes a first portion 32 that has an end affixed to the backside 18 of the panel 12 and extends centrally and longitudinally outwardly therefrom. The elastic section 22 has an end that is affixed to the first portion 32 by sewing (as illustrated by the broken line 34). This elastic section is longitudinally aligned with the first portion 32 and extends outwardly therefrom. The strap 20 includes a second portion 36 that is secured to the opposite end of the elastic section 22 opposite the first portion 32. The second portion 36 is also longitudinally aligned with the first portion 32 and the elastic section 22. The second fastener 26 extends transversely across the second portion 36 at an end thereof opposite the elastic section 22.

In the present invention, the elastic section 22 is particularly unique in that it allows the strap 20 to be adapted to a wide variety of widths of stadium seat benches. For example, if the bench is rather wide, the elastic section 22 can be pulled outwardly so as to allow the strap 20 to fit properly along the underside of the bench. The elasticity of the elastic section 22 should only be sufficient so as to allow the second fastener 26 to reach the first fastener 24. Each of the first fastener 24 and the second fastener 26 are complementary VELCRO™ hook-and-loop material strips. As such, they can be releasably secured to each other in a conventional manner.

Figure 2:
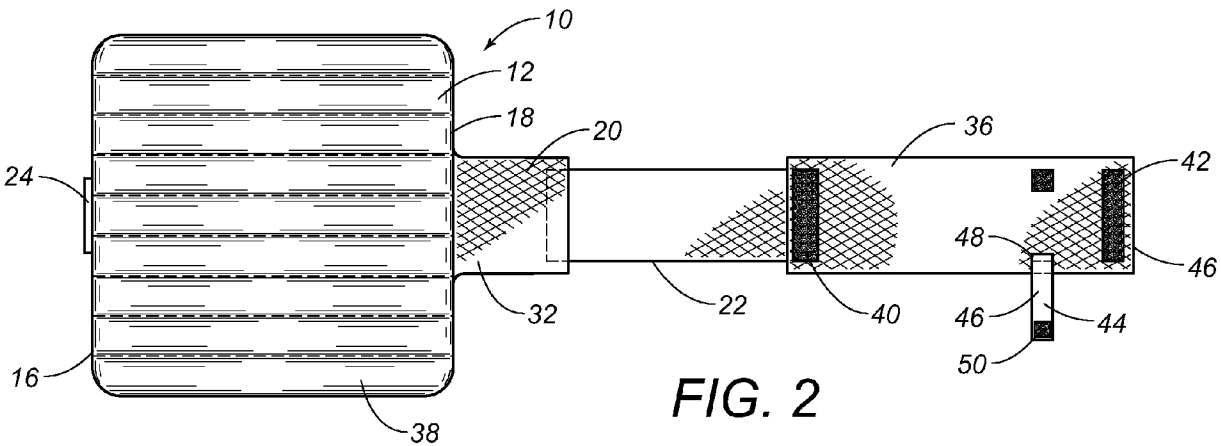
FIG. 2 is a plan view of the unfolded seat cushion of the preferred embodiment of the present invention showing the belt-receiving strip as extended outwardly from its connection.

FIG. 2 shows a top view of the seat cushion 10 of the present invention. In this top view, it can be seen that the inflatable panel 12 has a top surface 38. The panel 12 also includes a front side 16 and a back side 18. The first fastener 24 is secured to the front side 16 of the panel 12. The strap 20 extends outwardly from the back side 18.

In FIG. 2, it should be noted that the second portion 36 of the strap 20 includes a third fastener 40. The third fastener 40 includes a strip of hook-and-loop material that is positioned at an end of the second portion 36 adjacent to the elastic section 22. This third fastener 40 is configured to join with the first fastener 24 when the panel 12 is in a deflated and folded configuration (as will be described hereinafter). A display panel 42 is positioned at the opposite end of the second portion 36 of strap 20. The display panel 42 is configured so as to display the information whenever the seat cushion is placed upon a stadium bench or when the seat cushion is appropriately folded.

A belt-receiving member 44 is also affixed to a top surface of the strap 20. This belt-receiving member 44 is positioned between the third fastener 40 and the end 46 of the strap 20. In particular, this belt-engaging member 44 includes a strip 46 hingedly connected at 48 to the strap 20. This strip 46 has hook-and-loop material 50 affixed thereto at an end opposite the hinged connection 48 with the strap 20. The strip 46 will extend transverse to the longitudinal axis of the strap 20 and is positioned between the third fastener 40 and the end 46 of the strap on the top surface of the strap 20. A complementary hook-and-loop material 52 is affixed to the top surface of the strap 20. The hook-and-loop material 50 of the strip 46 is releasably engageable with the complementary hook-and-loop material 52 so as to define the belt-engaging member 44.

In FIG. 2 the top surface 38 of the inflatable panel 12 has a plurality of convolutions formed thereon. These convolutions are generally aligned with the convolutions 28 of the bottom surface 14.

Figure 3:
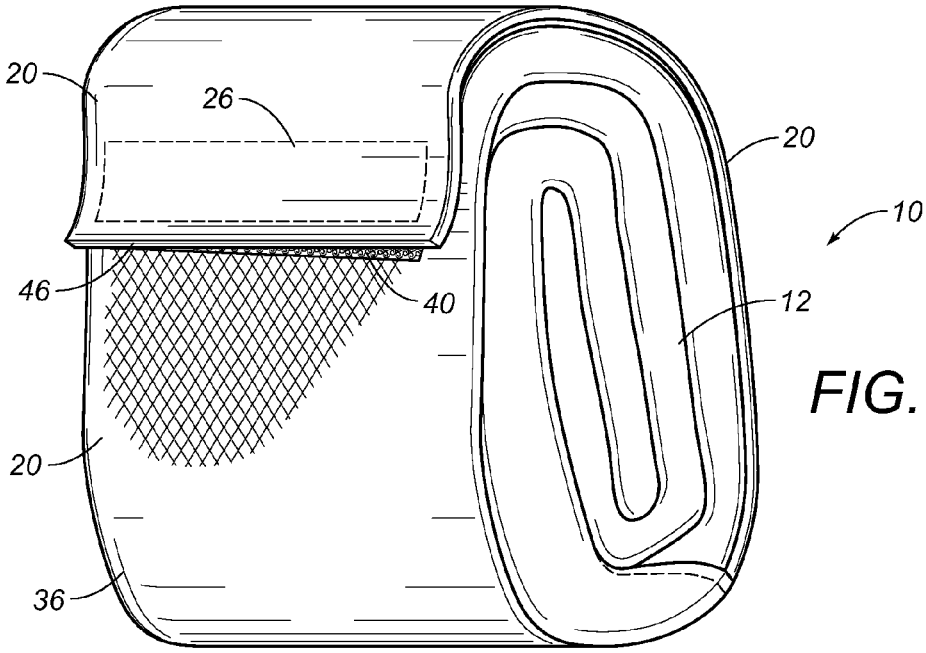
FIG. 3 is a frontal perspective view showing the seat cushion of the present invention as secured in a folded configuration.

FIG. 3 shows the folded configuration of the portable seat cushion 10 of the present invention. As can be seen, the inflatable panel 12 is generally deflated and folded upon itself. After folding upon itself, the panel can be rolled into a spiral configuration. The strap 20 will extend around the folded inflatable panel 12 so that the end 46 of the strap 20 has its hook-and-loop material strip 26 engaged with the complementary hook-and-loop material strip 40 at the opposite end of the second portion 36 of the strap 20. As such, the panel 20 is conveniently stowed within the interior of the strap 20 in a safe manner.

Figure 4:
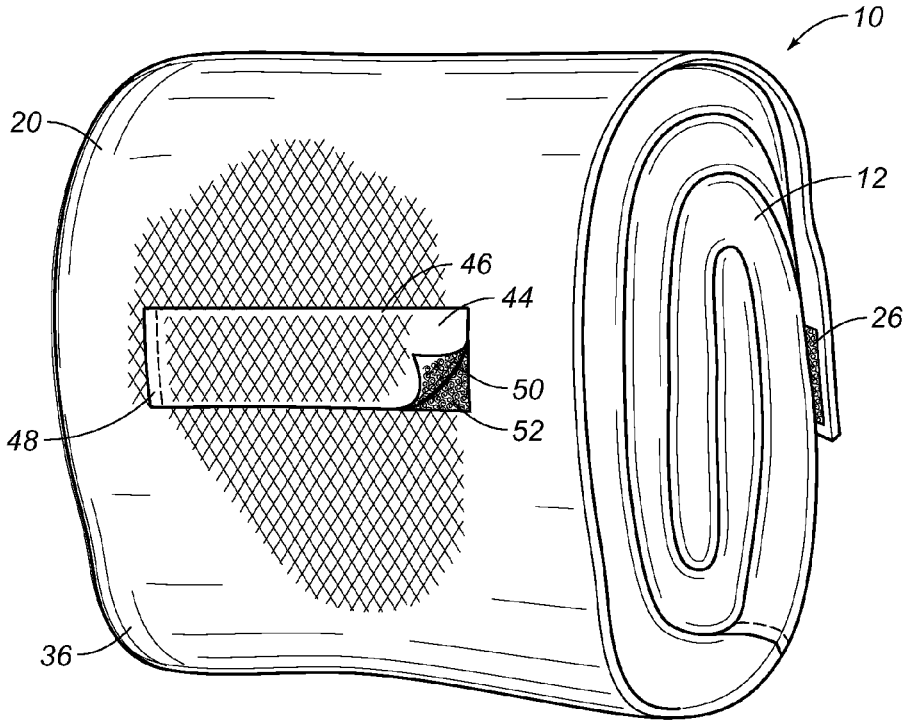
FIG. 4 is a rear elevational view showing the seat cushion of the present invention in its folded configuration.

FIG. 4 shows the opposite side of the folded seat cushion 10. In this configuration, the belt-receiving member 44 is located on the outer surface of the strap 20. The belt-receiving member 44 has strip 46 hinged about its hinge connection 46 such that the hook-and-loop material 50 engages the complementary hook-and-loop material 52 located on the surface of the second portion 36 of strap 20. Once again, the panel 12 is safely and securely folded within the interior of the strap 20. FIG. 4 further shows that the second fastener 26 is in a position so as to be engaged with the third fastener 40.

Figure 5:
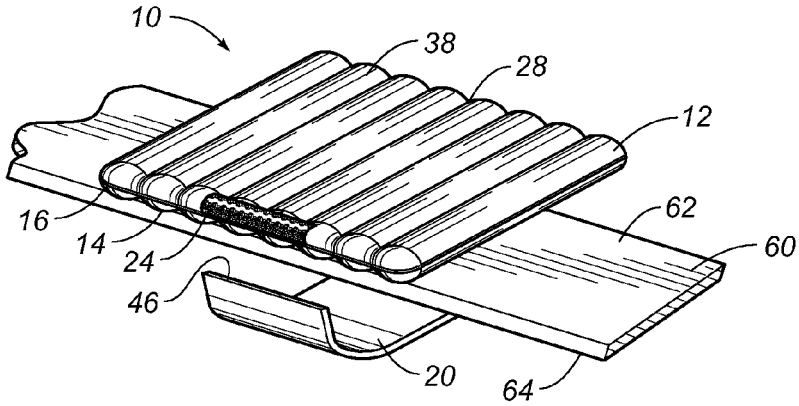
FIG. 5 is a perspective view of the seat cushion of the present invention as applied onto the surface of a bench.

FIG. 5 shows the seat cushion 10 as applied onto a bench 60. Bench 60 is in the nature of a bleacher or bench used in a stadium. Various types of bleachers and/or benches can properly and conveniently receive the seat cushion 10 of the present invention. Additionally, the seat cushion 10 can be utilized in other types of seating environments, such as the rigid or plastic seats often found in ballpark environments, on boats and in other outdoor activities.

In FIG. 5, it can seen that the inflatable panel 12 has its top surface 38 located in a position surface for allowing a person to sit thereon. The bottom surface 14 of the inflatable panel 12 is positioned against the top surface 62 of the bench 60. The strap 20 is extended below along the bottom side 64 of the bench 60. As a result, the end 46 of the strap 20 will be in a suitable position so as to attach to the first fastener 24 located on the front side 16 of the inflatable panel 12. FIG. 5 further shows how the convolutions 28 are configured when the inflatable panel 12 is inflated.

Figure 6:
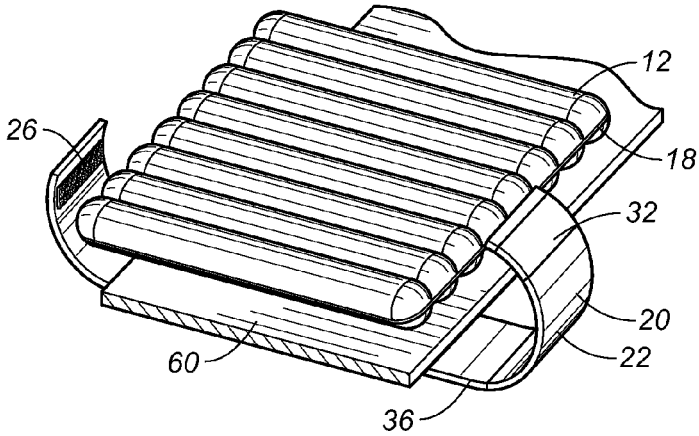
FIG. 6 is an end view of the seat cushion of the present invention as applied onto a bench.

FIG. 6 shows that, the inflatable panel 12 has the strap 20 extending from the back side 18 thereof. The bench 60 is positioned below the bottom of the inflatable panel 12. The strap 20 is illustrated as having its first portion 32 secured to the back side 18. The elastic section 22 is affixed to the first portion 32. The second portion 36 is affixed to the opposite end of the elastic section 22. The second fastener 26 is located at the opposite end of the second portion 36. The second fastener 26 is located in a desirable position for engaging the first fastener 28.

Figure 7:
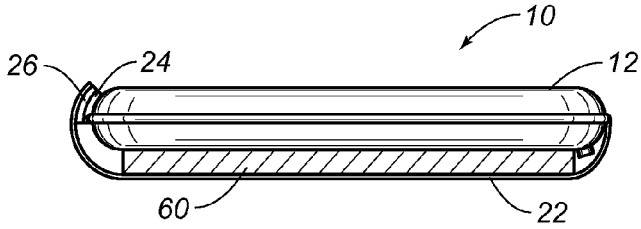
FIG. 7 is an end view of the seat cushion of the present invention as directed onto an underlying bench.

FIG. 7 shows that the strap 22 extends along the underside of the bench 60 in a firm and secure manner. The bottom surface of the inflatable panel 12 rests upon the top surface 62 of the bench 60. The second fastener 26 is illustrated as joined to the first fastener 24. In this configuration, the seat cushion 10 of the present invention is in its desired configuration for use.

Figure 8:
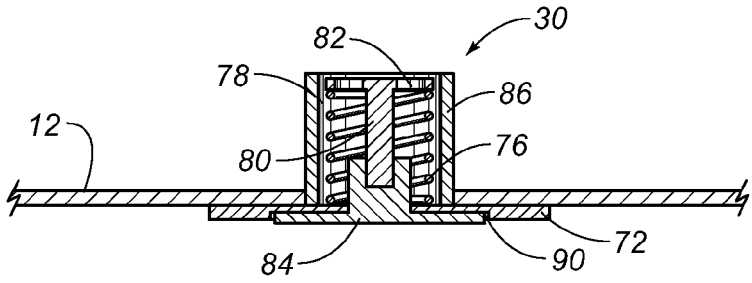
FIG. 8 is a cross-sectional view showing the valve as used on the seat cushion of the present invention.

FIG. 8 shows how the valve 30 is specifically configured and attached to the bottom surface 14 of the inflatable panel 12. Specifically, the valving 30 has a housing 70 with flange 72 affixed to an interior surface 74 of the bottom surface 14 of the inflatable panel 12. This flange can be secured by adhesives, welding or by other heat-sealing techniques. The housing 70 has a tubular portion 76 extending from the flange 72 outwardly of the bottom surface 14. The flange 72 and the tubular portion 76 of the housing 70 define a hole 78 extending therethrough. A button 80 is slidably mounted in the hole 78. The button 80 has a face 82 at one end thereof. A sealing member 84 is affixed to an end of the button 80 opposite the face 82. The sealing member 84 is positioned adjacent to the flange 72 on a side opposite the tubular portion 76. The sealing member 84 has a diameter greater than a diameter of the hole 78. A spring 86 is positioned within the hole 74 and bears against button 80 so as to urge the sealing member 84 against the flange 72.

In FIG. 8, it can be seen that the valve 30 is in its closed position. As a result, air cannot leak out of the interior of the inflatable panel 12.

Figure 9:
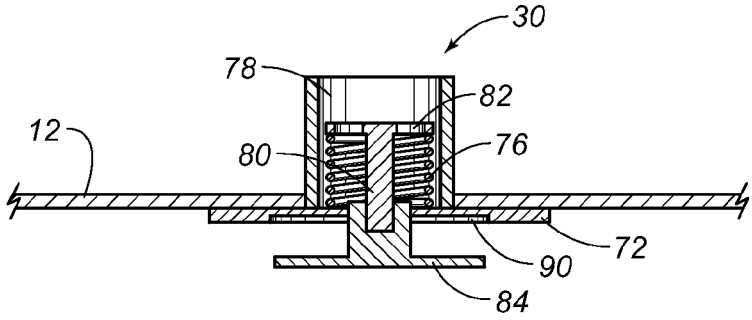
FIG. 9 is a cross-sectional view of the valve as used on the seat cushion of the present invention with the valve in its open position.

FIG. 9 illustrates the operation of the valve 30 so as to release air from the interior of the inflatable panel 12. As can be seen, the face 82 of the button 80 is depressed within the hole 78 so as to overcome the resistance of the spring 76. This depression can occur by the application of a finger force onto the face 82 of the button 80. As a result of this movement, the sealing member 84 is pushed outwardly of its seat 90 on the flange 72. This allows air to flow into and through the hole 78. As a result, when it is desired to deflate the inflatable panel 12, it is only necessary to apply force onto the face 82 of the button 80 so as to release air from the interior of the inflatable panel 12.

Figure 10:
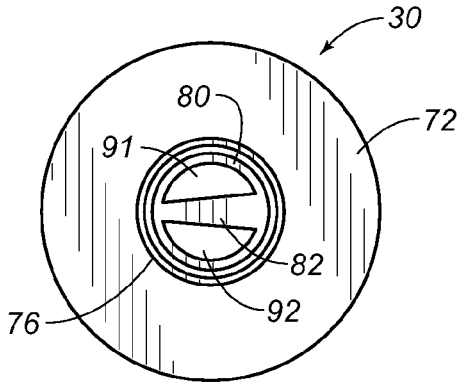
FIG. 10 is a plan view of the valve as used on the present invention.

In FIG. 10, the valving 30 is illustrated as isolated from the inflatable panel 12. It can be seen that the flange 72 has a generally circular configuration. Similarly, the tubular portion 76 is also of a circular configuration. The button 80 is fit within the interior of the tubular portion 76. The button 80 has face 82 at the top thereof. As can be seen, the face 82 can display the logo or team emblem associated with the cushion 10. Air passageways 91 and 92 are formed on opposite sides of the face 82. This allows air to be easily introduced through the hole 78. In the present invention, the spring 76 should have a suitable resiliency so as to allow a human breath to urge the sealing member 84 to its position shown in FIG. 9.

Figure 11:
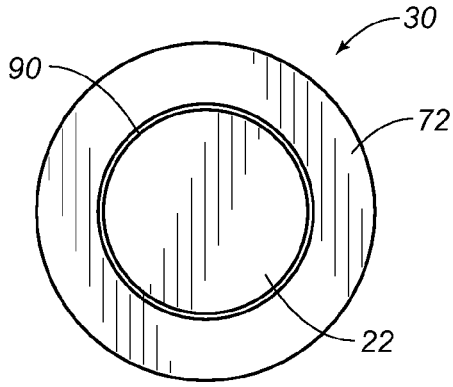
FIG. 11 is a bottom view of the valve as used on the present invention.

In FIG. 11, the bottom surface of the valve 30 is particular shown. As can be seen, the flange 72 has a circular seat 90 formed therein. The sealing member 84 is positioned within the seat 90.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A portable seat cushion for use on a bench comprising:

an inflatable panel having a top surface and a bottom surface joined together so as to define an interior compartment, said panel having a front side and a back side;

a strap having an end affixed to said back side of panel and extending outwardly therefrom, said strap having a elastic section formed therealong;

a first fastener affixed to said front side of said panel;

a second fastener affixed to said strap at an opposite end of said panel, said second fastener suitable for affixing to said first fastener when said bottom surface of said panel is placed upon the bench and said strap is extended along an underside of the bench toward said front side of said panel; and a valving means affixed to one of said top surface and said bottom surface of said panel, said valving means for allowing air to be selectively introduced into and released from said interior compartment of said panel, said valving means comprising:

a housing having a flange affixed to an interior surface of said one of said top surface and said bottom surface, said housing having a tubular portion extending from said flange outwardly of said one of said top surface and said bottom surface, said tubular portion and said flange defining a hole extending therethrough;

a button slidably mounted in said hole, said button having a face at one end thereof;

a sealing member affixed to an end of said button opposite said face, said sealing member positioned adjacent said flange on a side opposite said tubular portion, said sealing member having a diameter greater than a diameter of said hole; and a spring positioned within said hole and bearing against said button so as to urge said sealing member against said flange.

2. The seat cushion of claim 1, said top surface having a plurality of convolutions defined thereon when said panel is inflated.

3. The seat cushion of claim 2, said bottom surface having a plurality of convolutions defined thereon when said panel is inflated.

4. The seat cushion of claim 3, said convolutions of said top surface being aligned with said convolutions of said bottom surface.

5. The seat cushion of claim 1, said strap having a top surface and a bottom surface, said second fastener affixed to said bottom surface of said strap.

6. The seat cushion of claim 5, further comprising:

a third fastener affixed to a top surface of said strap inwardly of said end thereof, said third fastener joined to said first fastener when said panel is deflated and folded.

7. The seat cushion of claim 6, said elastic section extending between said third fastener and said panel, said strap comprising:

a first portion extending outwardly from said backside of said panel, said elastic section having an end opposite said panel joined to said elastic section; and a second portion having an end joined to an end of said elastic section opposite said first portion, said second and third fasteners being affixed to said second portion.

8. The seat cushion of claim 7, said spring having a resiliency suitable for allowing said sealing member to move away from said flange upon an application of human-produced breath through said hole.

9. The seat cushion of claim 1, said first fastener being a section of hook-and-loop material, said second fastener being a section of complementary hook-and-loop material.

10. A portable seat cushion comprising:

an inflatable panel having a top surface and a bottom surface joined together to define an interior compartment, said panel having a front side and a back side;

a strap having an end affixed to said back side of panel and extending outwardly therefrom;

a first fastener affixed to said front side of said panel;

a second fastener affixed to said strap at an end opposite said panel, said second fastener suitable for affixing to said first fastener when said strap extends along and beneath said bottom surface of said inflatable panel, said strap having a top surface and a bottom surface, said second fastener affixed to said bottom surface of said strap;

a third fastener affixed to a top surface of said strap inwardly of said end thereof, said third fastener joinable to said first fastener when said panel is deflated and folded, said first fastener being a section of hook-and-loop material, each of said second fasteners being a section of hook-and-loop material complementary to said hook-and-loop material of said first fastener, said strap comprising:

a first portion extending outwardly from said back side of said panel;

an elastic section having an end joined to said first portion and extending longitudinally outwardly therefrom; and a second portion having an end joined to an end of said elastic section opposite said first portion, said second and third fasteners being affixed to said second portion.

11. The seat cushion of claim 10, said top surface having a plurality of convolutions defined thereon when said panel is inflated, said bottom surface having a plurality of convolutions defined thereon when said panel is inflated.

12. A portable seat cushion comprising:

an inflatable panel having a top surface and a bottom surface joined together to define an interior compartment, said panel having a front side and a back side;

a strap having an end affixed to said back side of panel and extending outwardly therefrom;

a fastener affixed to said strap and to said inflatable panel so as to allow said strap to be affixed to a side or a surface of said inflatable panel when extended below said bottom surface of said inflatable panel; and a valving means affixed to one of said top surface and said bottom surface of said inflatable panel, said valving means for allowing air to be selectively introduced into and released from said interior compartment of said panel, said valving means comprising:

a housing having a flange affixed to an interior surface of said one of said top surface and said bottom surface, said housing having a tubular portion extending from said flange outwardly of said one of said top surface and said bottom surface, said tubular portion and said flange defining a hole extending therethrough;

a button slidably mounted in said hole, said button having a face at one end thereof;

a sealing member affixed to an end of said button opposite said face, said sealing member positioned adjacent said flange on a side opposite said tubular portion, said sealing member having a diameter greater than a diameter of said hole; and a spring positioned within said hole and bearing against said button so as to urge said sealing member against said flange.

13. The seat cushion of claim 12, said spring having a resiliency suitable for allowing said sealing member to move away from said flange upon an application of human-produced breath through said hole.

14. The seat cushion of claim 12, said button having an orifice formed on said face, said orifice suitable for allowing air to pass therethrough toward said sealing member.

* * * * *